US005896410A

United States Patent [19]

Nguyen et al.

[11] Patent Number: 5,896,410

[45] Date of Patent: Apr. 20, 1999

[54] COMPACT FURNACE DESIGN

[75] Inventors: Duong Nguyen, National City; Randall Newcomb, Lakeside; Lawrence Kaserman, San Diego, all of Calif.

[73] Assignee: D.S. Fibertech Corporation, Santee, Calif.

[21] Appl. No.: 08/539,709

[22] Filed: Oct. 5, 1995

[51] Int. Cl.[6] ..... H05B 6/36; H05B 3/46

[52] U.S. Cl. ..... 373/153; 373/155; 373/156; 373/127; 373/130

[58] Field of Search ..... 273/4, 5, 6, 7, 273/45, 71, 72, 109, 111, 119, 122, 127, 128–130, 137, 144, 155, 156, 152, 153; 219/390; 1/452

[56] References Cited

U.S. PATENT DOCUMENTS

| | | | |
|---|---|---|---|
| 1,924,079 | 8/1933 | Campbell | 373/130 |
| 2,035,306 | 3/1936 | Fannin | 373/130 |
| 2,744,946 | 5/1956 | Lewicki | 373/130 |
| 3,786,162 | 1/1974 | Colson | 219/390 |
| 4,423,516 | 12/1983 | Mellen, Sr. | 373/111 |

*Primary Examiner*—Tu Ba Hoang

[57] ABSTRACT

A high temperature furnace formed from a stack of ceramic fiber—toroidal discs each fabricated to have an upper and lower groove for accommodating a heating coil so as to permit thermal elongation without buckling. The stacked array form a hollow cylindrical inner chamber which receives heat in the form of radiation through a window formed by removing a portion of the material between the groove and inner chamber.

3 Claims, 1 Drawing Sheet

COMPACT FURNACE DESIGN

BACKGROUND—FIELD OF INVENTION

This invention relates generally to high temperature heating chambers, and in particular to heating chambers which utilize electrical heating elements embedded in vacuum formed ceramic fiber materials.

BACKGROUND—DISCUSSION OF PRIOR ART

High temperature heating chambers are commercially used to prepare materials and carry out various processes, both for industrial production as well as laboratory experiment. Such chambers typically utilize one or more helically wound high wattage electrical coils that are positioned within the inner circumference of a surrounding cylindrical insulating material. The coils may be secured to the cylinder by ceramic spacer fasteners, or they may be physically partially embedded within the insulating material during fabrication. The primary design objective is to concentrate, for a given amount of input wattage, as much heat as possible within the volume encompassed by the coils.

In addition, it is essential to maintain spatial temperature uniformity, and it is desirable that the thermal time constant be as small as possible—both from the stand point of regulation and control, as well as power consumption.

A paramount problem with such devices is that of preventing "coil meandering." The successive heat cycles result in expansions and contractions so that the coils themselves gradually experience an elongation (growth) which causes them to buckle and/or sag between their mounting separators (typically anchor pins embedded into the surrounding insulating material). After a large number of cycles, the anchor pins themselves may "work out" of the insulating foundational structure—the combined effect of this coil growth and material fatigue eventually resulting in shorts between adjacent turns of the heating coils or the hot element contacting the load resulting in damage. Other structural shortcomings of prior art furnaces are found to be due to the expansion and contraction of the insulating material itself. This thermal stress tends to produce cracks which decrease in overall furnace performance. Still other shortcomings are associated with the inefficient re-radiation of thermal energy.

The actual problem posed is that of producing an efficient, uniform high temperature furnace wherein the heating coils are secured so as to prevent them from sagging or buckling due to coil growth, accordingly:

OBJECTS AND ADVANTAGES

A primary object of the invention is to provide a furnace configuration which contains an internally cradled electric coil.

Another object of the invention is to provide a furnace configuration for retaining an electrical coil which will allow it to elongate without buckling.

A further object of the invention is to provide efficient radiation and re-radiation of thermal energy within the heating chamber.

Other objects and advantages of the invention will be obvious from the detailed description of a preferred embodiment given herein below.

SUMMARY, RAMIFICATIONS, AND SCOPE

The specification discloses a furnace comprised of a stack of ceramic fiber-toroidal discs each of which is fabricated to have an upper and lower groove near its open inner periphery. When the toroidal discs are stacked together, the grooves line up vertically, one on the top of the other—the approximately circular gap so formed by the top and bottom grooves being slightly larger than that necessary to accommodate the heating coil so as to allow a predetermined amount of growth before some limiting elongation is reached. The stacked array forms a hollow cylindrical inner chamber. Each heating element rests within the upper groove of a lower disc, in a cradle-like manner, the complete loop being captured between the space formed by the upper and lower grooves on the adjacent toroidal discs. A portion of the material between the groove and the inner periphery is removed so as to form a window like slot to facilitate radiation into the hollow inner chamber. This window permits maximum inward radial radiation while at the same time being sufficiently smaller than the coil diameter to prevent its removal. The configuration thus secures the heating element and at the same time produces a high percentage of direct radiation in the direction of the inner chamber. Additional re-radiation is obtained by treating the inner peripheries of the toroidal discs with coatings.

DESCRIPTION OF DRAW

DETAILED DESCRIPTION OF A PREFERRED EMBODIMENT

Figure 2:
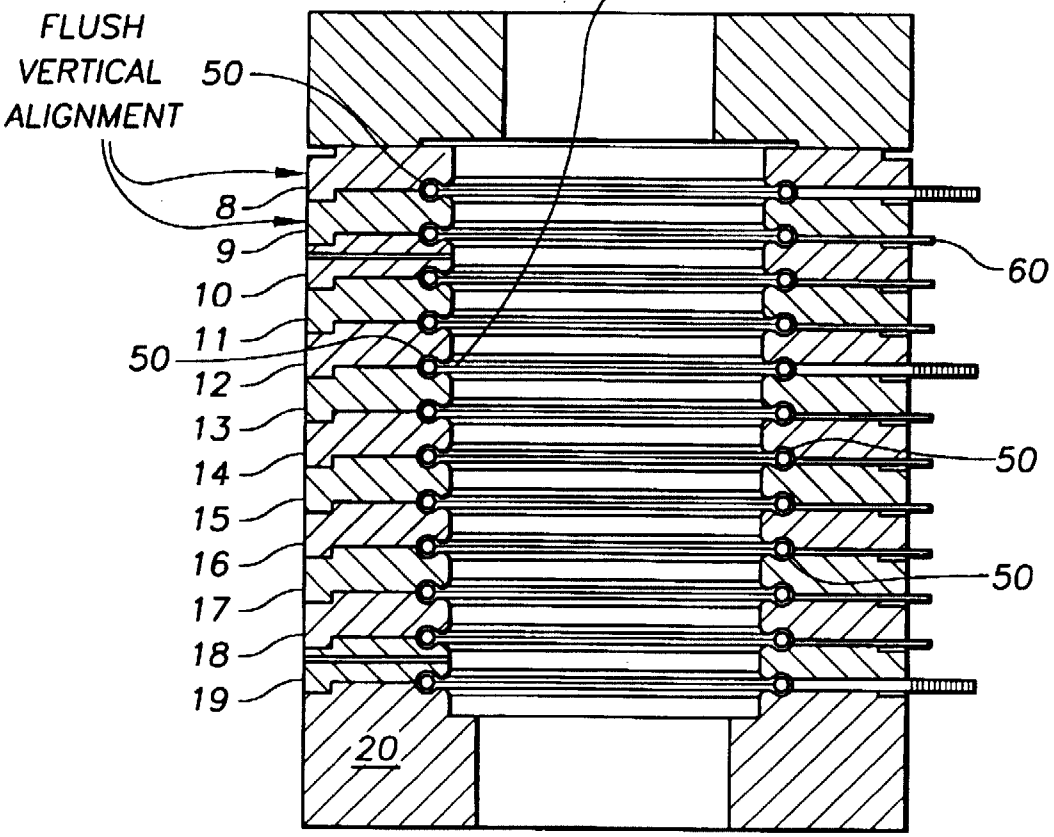
FIG. 2 shows a cross-sectional view taken through the section AA of FIG. 1 illustrating the construction of a furnace fabricated in accordance with the teachings of the invention.
Figure 3:
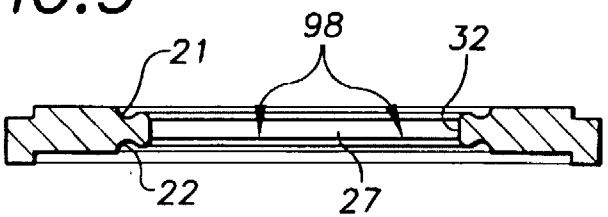
FIG. 3 shows a cross-section of one of the insulating discs which forms the stack.

Adverting to the drawings, and particularly FIG. 2 and FIG. 3 a preferred embodiment of the invention comprises a plurality of thermal fiber insulating toroidal discs 8–20, each of the internal discs 9–19 being formed to have a pair of half circle recesses 21 and 22 near its inner circumferential boundary 27 of a size sufficient to accommodate the diameter of a heating coil 50. As shown in the detail of FIG. 3, the upper recess 21 is slightly greater than the lower recess 22 so as to allow some movement rearwardly along the direction of increasing radius as the coils expand. When assembled as a stacked array as in FIG. 2, the adjacent discs (i.e., 12 and 13) form a window 24 which permits thermal energy to be radiated radially inwardly (toward the cylindrical cavity 30).

Referring to FIG. 3, in a preferred embodiment of the invention the inner circumferential surface 32 is preferably treated with a substance which will optimize the re-radiation characteristic of the assembly. In some cases, enhanced thermal performance is obtained if surface 32 is blackened so as to emulate a black body radiator at certain energies. In other cases, the surface 32 will enhance thermal efficiency if it is made reflective.

Figure 1:
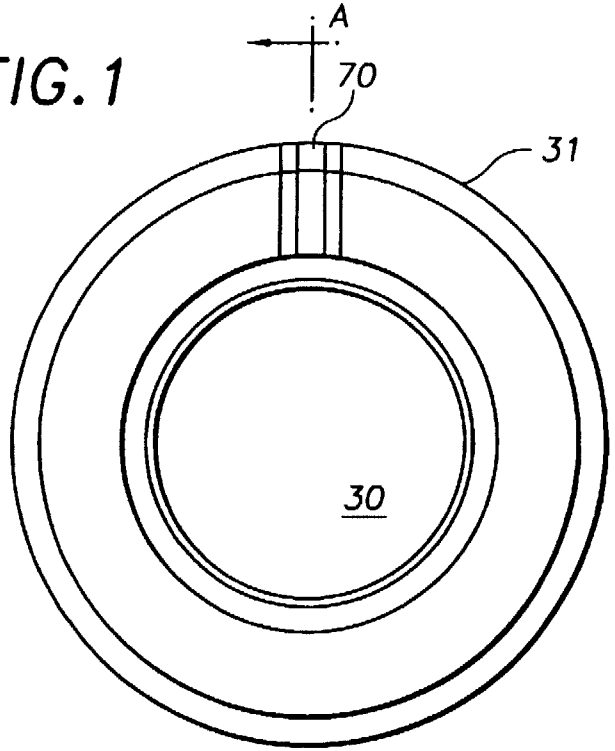
FIG. 1 shows a plan view of the disc and coil assembly

Each of the separate coils 50 (identified as HTR 1–12) shown in FIG. 2 are connected to a voltage supply via their individual electrical elements 60 which exit through the space identified as lead slots 70 in FIG. 1. For 3 phase operation, the connections between every 3rd coil are tied together by a common conductor. Preferably the entire stack is encased within additional insulating material and enclosed within a stainless steel shell which is not shown as it forms no part of the novelty of the invention.

The inner chamber 30 of the stack will, in most cases, be circular in cross-section, although the teachings of the invention will be equally applicable to any other geometry, such as a square, rectangle, oval and the like. Similarly, a cylindrical outer shell 31 will be advantageous in most applications, but other configurations and other materials such as aluminum may be preferable in some situations. It will also be understood that although the drawings disclose a plurality of discs and heating coils, the teachings of the invention are equally applicable to units with only one element, or to a chamber in which the wires in the coil recesses are designed to accommodate different size wires at different elevations where the vertical geometry of the stack changes with height.

When the heating chamber is used, the wire heating elements cycle between higher and lower temperatures causing the length to increase and decrease—the resulting long term effect being an elongation. The size of the volume formed by the upper and lower recesses (i.e., 21 and 22) provides sufficient space to accommodate this growth, thus avoiding the shortcomings of the prior art structures.

An additional problem present in some high temperature furnaces results from the cracking of the insulating material due to thermal cycling. The present invention obviates this problem, the individual toroidal discs being constructed to have one or more built-in gaps 98 which are engineered to take up the expansion and contraction to avoid cracking.

Thus, although the concept has been shown and described by reference to a particular embodiment, it will be understood that the novelty is not limited thereto, and that numerous changes, modifications and contributions may be made without departing from the spirit of the invention.

What is claimed is:

1. A high temperature furnace comprising:

at least a first insulating toroidal disc having parallel flat upper and lower surfaces, said upper surface having a groove adjacent to its inner periphery of a first depth, and;

at least a second insulting toroidal disc having parallel flat upper and lower surfaces, said lower surface having a groove adjacent to its inner periphery of a second depth which is greater than the depth of the groove in said first insulating toroidal disc, at least a first heating coil, wherein said first and second insulating toroidal discs are fastened together for defining a gap formed by the groove in said lower surface of said second disc and the groove in said upper surface of said first disc whereby said first heating coil will be captured within said gap to permit said first heating coil to thermally expand into the larger said second depth of said second insulating toroidal disc, and at least one radial electrode recessed within said first and second insulating toroidal discs for making an electrical connection to said first heating coil.

2. A high temperature furnace comprising:

At least one heating, coil having a circular cross section;

at least one first insulating disc having a central void and at least one groove adjacent to the void of a width sufficient to accommodate the cross sectional diameter of said heating coil and a depth sufficient to accommodate the cross sectional radius of said heating coil;

at least one second insulating discs having a central void and at least one groove adjacent to the void of a width greater than the width of the groove in said first insulating disc for accommodating thermal expansion wherein;

said first and second insulating discs are fastened together to positionally align said central voids for forming a furnace heating chamber and for defining a gap formed by said grooves to accommodate thermal expansion of said coil at the groove of said second disc.

3. A high temperature furnace according to claim 2 wherein said second insulating disc has a groove with the width and depth which corresponds to the width and depth of said groove in said first insulating disc, and where said first and second insulating discs are positioned one above the other so as to place said groove of said first insulating disc adjacent to said groove of said second insulating disc.

* * * * *